US010160571B2

(12) United States Patent
Chen et al.

(10) Patent No.: US 10,160,571 B2
(45) Date of Patent: Dec. 25, 2018

(54) LOCK PACKAGE HAVING PACKAGE HOLDER

(71) Applicant: TAIWAN FU HSING INDUSTRIAL CO., LTD., Kaohsiung (TW)

(72) Inventors: Shu-Hui Chen, Kaohsiung (TW); Wan-Lin Hsieh, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 204 days.

(21) Appl. No.: 15/273,729

(22) Filed: Sep. 23, 2016

(65) Prior Publication Data

US 2017/0361986 A1 Dec. 21, 2017

(30) Foreign Application Priority Data

Jun. 17, 2016 (TW) ..... 105209132 A

(51) Int. Cl.

| | |
|---|---|
| ***B65D 25/04*** | (2006.01) |
| ***B65D 81/02*** | (2006.01) |
| ***B65D 85/00*** | (2006.01) |
| ***B65D 71/00*** | (2006.01) |
| ***B65D 5/50*** | (2006.01) |
| ***B65D 85/62*** | (2006.01) |

(52) U.S. Cl.

CPC ..... *B65D 25/04* (2013.01); *B65D 5/505* (2013.01); *B65D 5/5059* (2013.01); *B65D 71/00* (2013.01); *B65D 81/025* (2013.01); *B65D 85/00* (2013.01); *B65D 85/54* (2013.01); *B65D 85/62* (2013.01)

(58) Field of Classification Search

CPC ..... B65D 25/04; B65D 85/62; B65D 5/5059; B65D 85/34; B65D 81/025; B65D 25/10; B65D 25/108

USPC ..... 206/321, 593, 419, 774, 756, 765, 418, 206/763

See application file for complete search history.

(56) References Cited

U.S. PATENT DOCUMENTS

| | | | | | |
|---|---|---|---|---|---|
| 2,670,892 | A * | 3/1954 | Kendrick | B65D 5/4216 | 206/321 |
| 3,015,428 | A * | 1/1962 | Magazzu | B65D 5/504 | 206/321 |
| 3,326,362 | A * | 6/1967 | Smith | B65D 5/5016 | 206/321 |
| 3,407,921 | A * | 10/1968 | Cilluffo | B65D 5/5007 | 206/418 |
| 4,307,803 | A * | 12/1981 | Johnson | B65D 5/5038 | 206/321 |
| D315,302 | S * | 3/1991 | Kistler | D9/415 | |
| 5,064,056 | A * | 11/1991 | Gresh | B65D 75/32 | 206/321 |
| 6,401,932 | B1 * | 6/2002 | Weinstein | B65D 25/24 | 206/320 |

(Continued)

*Primary Examiner* — Steven A. Reynolds

(74) *Attorney, Agent, or Firm* — CKC & Partners Co., Ltd.

(57) ABSTRACT

A lock package is provided. The package holder is suitable to simultaneously position at least two locks. The package holder includes a plate portion and a partition. The plate portion has two opposite surfaces, at least two positioning portions, and a non-positioning portion. The surfaces are configured to be disposed with the locks. The positioning portions are configured to position plural escutcheons of the locks, and a portion of each of the escutcheons is exposed, in which the non-positioning portion is configured to cover a plurality of handles of the locks.

9 Claims, 5 Drawing Sheets

(56) References Cited

U.S. PATENT DOCUMENTS

| | | | | |
|---|---|---|---|---|
| 8,087,213 | B2 * | 1/2012 | Dhuru | B65D 5/0254 206/779 |
| 9,139,349 | B2 * | 9/2015 | Lu | B65D 75/225 |

* cited by examiner

LOCK PACKAGE HAVING PACKAGE HOLDER

RELATED APPLICATIONS

This application claims priority to Taiwan Application Serial Number 105209132, filed on Jun. 17, 2016, which is incorporated herein by reference.

BACKGROUND

Field of Invention

The present invention relates to a holder and a package using the holder. More particularly, the present invention relates to a package holder and a lock package using the package holder.

Description of Related Art

Most packages for locks are retail. However, the retail package of the lock includes an inner box with a set of lock disposed thereon and an outer box which is used to accommodate the inner box. Such a retail package design not only results in a complex assembling process and packaging material wasting, but also occupies a lot of space.

In addition, when a consumer needs to buy more than one set of lock, or a wholesaler needs to transport a large number of locks at the same time, plural single lock packages are inconvenient for the consumer or the wholesaler to take and also occupy a lot of transport space.

SUMMARY

The invention provides a package holder and a lock package, which can reduce the overall volume of plural sets of locks and prevent the locks from colliding with each other.

According to the aforementioned object, a package holder is provided. The package holder is suitable to simultaneously position a first lock and a second lock. The package holder includes a plate portion, a first side plate and a second side plate. The plate portion has a first surface, a second surface opposite to the first surface, a first side edge and a second side edge opposite to the first side edge. The first lock and the second lock are respectively disposed adjacent to the second surface and the first surface. The plate portion further includes a first positioning portion and a second positioning portion. The first positioning portion penetrates the first surface and the second surface, in which the first positioning portion is disposed adjacent to the first side edge, and the first positioning portion is configured to position the first lock. The second positioning portion penetrates the first surface and the second surface, in which the second positioning portion is disposed adjacent to the second side edge, and the second positioning portion is configured to position the second lock. The first side plate is connected to the first side edge. The second side plate is connected to the second side edge, in which an accommodating space is formed between the first side plate, the second side plate and the second surface, and the accommodating space is configured to accommodate the first lock.

According to the aforementioned object, a lock package is provided. The lock package includes a first lock, a second lock and a first package holder. The first package holder includes a first plate portion, a first side plate and a second side plate. The first plate portion has a first surface, a second surface opposite to the first surface, a first side edge and a second side edge opposite to the first side edge. The first lock, and the second lock are respectively disposed adjacent to the second surface and the first surface. The first plate portion further includes a first positioning portion and a second positioning portion. The first positioning portion penetrates the first surface and the second surface, in which the first positioning portion is disposed adjacent to the first side edge, and the first positioning portion is configured to position the first lock. The second positioning portion penetrates the first surface and the second surface, in which the second positioning portion is disposed adjacent to the second side edge, and the second positioning portion is configured to position the second lock. The first side plate is connected to the first side edge. The second side plate is connected to the second side edge, in which a first accommodating space is formed between the first side plate, the second side plate and the second surface, and the first accommodating space is configured to accommodate the first lock.

According to an embodiment of the present invention, the aforementioned lock package further includes a second package holder. The second package holder is disposed above the first package holder. The second package holder includes a second plate portion, a third side plate and a fourth side plate. The second plate portion further includes a third positioning portion and a fourth positioning portion. The third positioning portion penetrates the third surface and the fourth surface, in which the third positioning portion is disposed adjacent to the third side edge, and the third positioning portion is configured to position the second lock. The fourth positioning portion penetrates the third surface and the fourth surface, in which the fourth positioning portion is disposed adjacent to the fourth side edge, and the fourth positioning portion is configured to position a third lock. The third side plate is connected to the third side edge. The fourth side plate is connected to the fourth side edge, in which a second accommodating space is formed between the third side plate, the fourth side plate and the fourth surface, and the second accommodating space is configured to accommodate the second lock.

According to the aforementioned object, another package holder is provided. The package holder is suitable to simultaneously position at least two locks. The package holder includes a plate portion and a partition. The plate portion has two opposite surfaces, at least two positioning portions, and a non-positioning portion. The surfaces are configured to be disposed with the locks. The positioning portions are configured to position plural escutcheons of the locks, and a portion of each of the escutcheons is exposed, in which the non-positioning portion is configured to cover a plurality of handles of the locks.

It can be known from the aforementioned embodiments of the present invention that, one package holder can use its the first side plate, a second side plate, the first partition and the second partition package holder to be stacked with another package holder. Meanwhile, the package holder can prevent the locks from colliding with each other. In addition, the first positioning portion and the second positioning portion of the package holder can position and fix the locks. Therefore, by alternately arranging the package holders and the locks, the overall volume of the lock package thereof can be reduced. Moreover, the package holders can be stacked stably with each other by using the weight of locks, so as to increase stability of the overall lock package.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
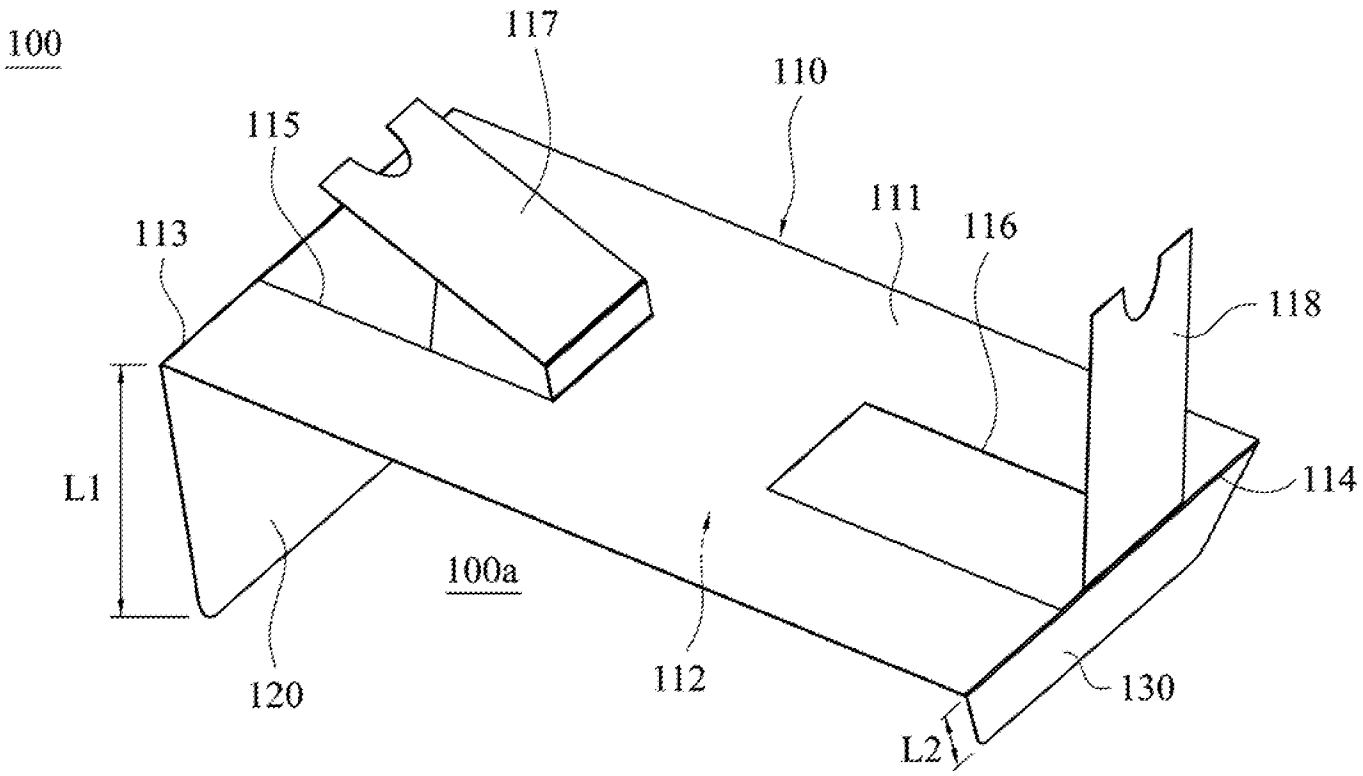
FIG. 1 is a schematic structural diagram showing a package holder in accordance with an embodiment of the present invention.
Figure 3:
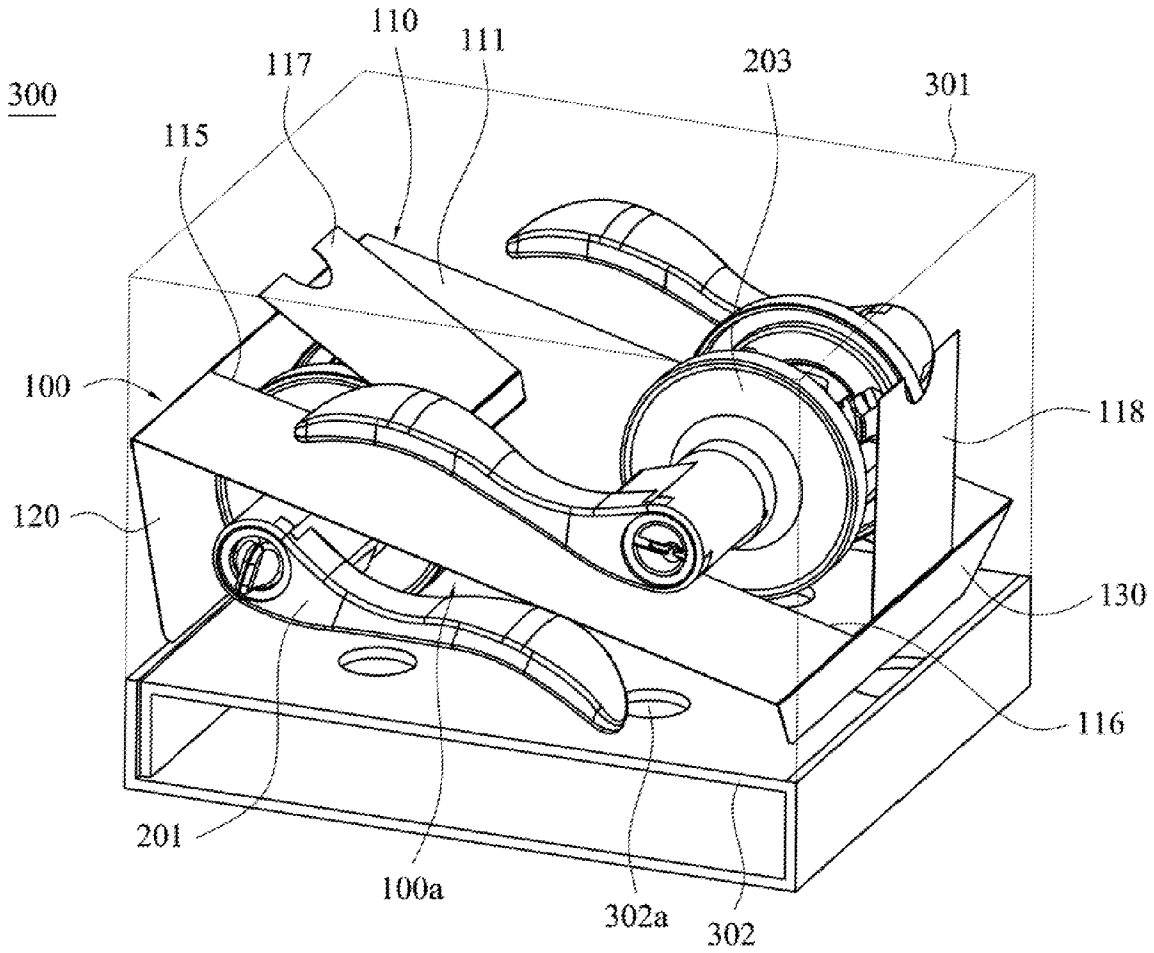
FIG. 3 is a schematic three-dimensional diagram showing a lock package in accordance with an embodiment of the present invention.

Referring to FIG. 1, FIG. 1 is a schematic structural diagram s ho wing a package holder 100 in accordance with an embodiment of the present invention. The package holder 100 of the present embodiment is mainly used to simultaneously position a first lock 201 and a second lock 203 as shown in FIG. 3. More specifically, the package holder 100 is used to position the first lock 201 and the second lock 203 and to partition off the first lock 201 from the second lock 203, so as to prevent the first lock 201 and the second lock 203 from colliding with each other and to reduce the space occupied by the first lock 201 and the second lock 203. It is noted that, the present embodiment uses one package holder 100 collocated with two locks (i.e. the first lock 201 and the second lock 203) as an example for explanation, the numbers of the package holder 100 and the locks of the present invention are not limited thereto. In other embodiments, the number of the package holder 100 can be determined by users according to the number of the locks or other requirements.

Figure 2:
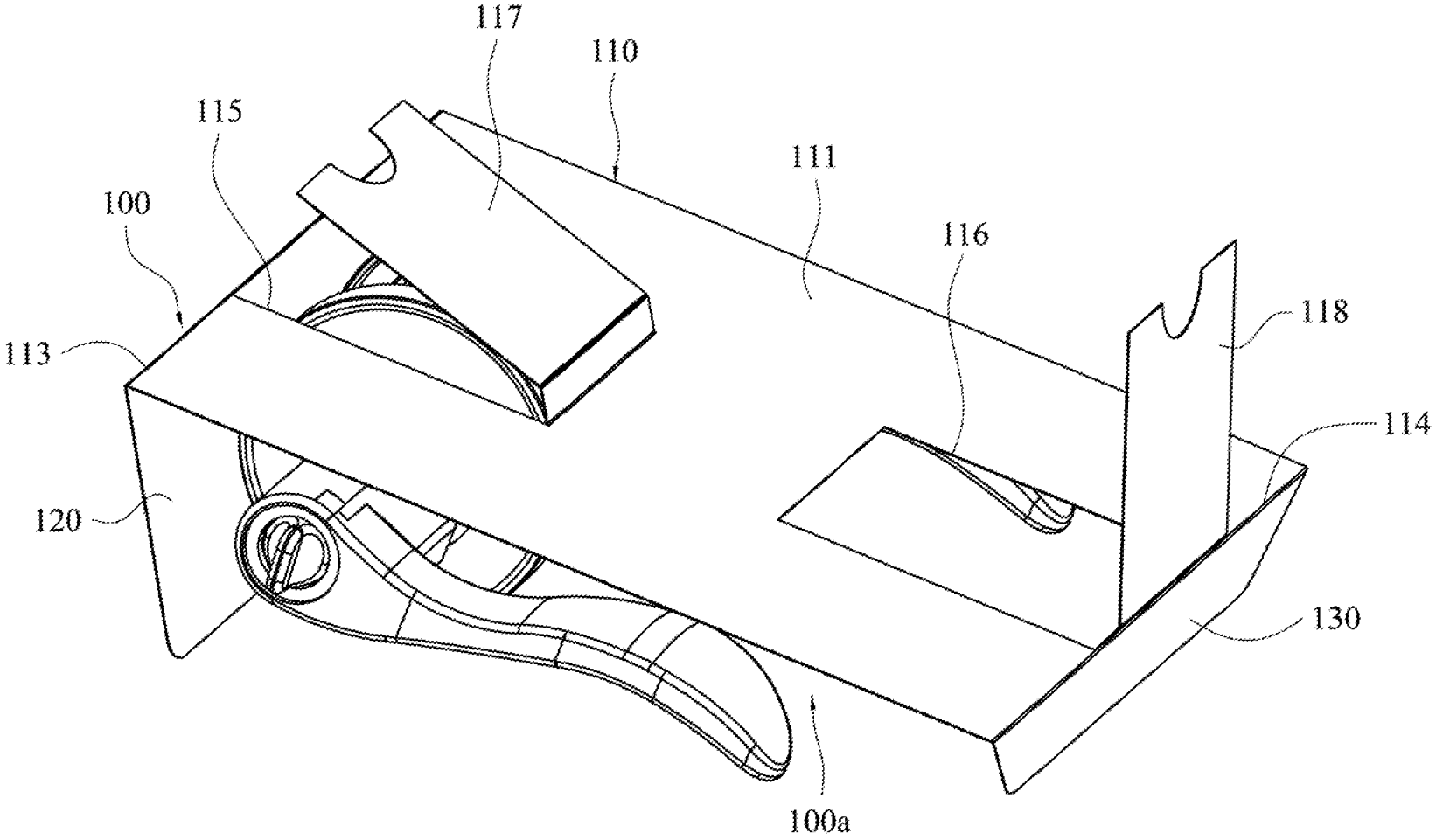
FIG. 2 is a schematic three-dimensional diagram showing the package holder disposed on a first lock in accordance with an embodiment of the present invention.

Referring to FIG. 1 again, the package holder 100 is in an inverse shape and mainly includes a plate portion 110, a first side plate 120 and a second side plate 130. The first side plate 120 and the second side plate 130 are disposed on two opposite sides of the plate portion 110. The plate portion 110 has a first surface 111, a second surface 112 opposite to the first surface 111, a first side edge 113 and a second side edge 114 opposite to the first side edge 113. In the present embodiment, the first side plate 120 is connected to the first side edge 113, and the second side plate 130 is connected to the second side edge 114. Referring to FIG. 2, FIG. 2 is a schematic three-dimensional diagram showing the package holder 100 disposed on the first lock 201 in accordance with an embodiment of the present invention. The first side plate 120 and the second side plate 130 protrude from the second surface 112, and an accommodating space 100*a* is formed between the first side plate 120 the second side plate 130 and the second surface 112. The first lock 201 can be disposed in the accommodating space 100*a*. In other words, the first lock 201 is disposed adjacent to the second surface 112 of the plate portion 110.

Referring to FIG. 1 and FIG. 2, the plate portion 110 further includes a first positioning portion 115 and a second positioning portion 116. In the present embodiment, the first positioning portion 115 penetrates the first surface 111 and the second surface 112 of the plate portion 110, and the first positioning portion 115 is located adjacent to the first side, edge 113. The first positioning portion 115 is mainly configured to position the first lock 201 in the accommodating space 100*a*. More specifically, the first positioning portion 115 can be an opening, and the shape of the opening is designed according to the shape of a portion of the first lock 201 which is desired to be positioned. In one example, the first positioning portion 115 is a rectangular opening, and an escutcheon of the first lock 201 can be engaged in the first positioning portion 115, such that the first lock 201 can be positioned.

In the present embodiment, the second positioning portion 116 penetrates the first surface 111 and the second surface 112 of the plate portion 110, and the second positioning portion 116 is located adjacent to the second schematic three-dimensional diagram showing a lock package 300 in accordance with an embodiment of the present invention. The second positioning portion 116 is mainly configured to support the second lock 203 and to position the second lock 203 on the first surface 111. More specifically, the second positioning portion 116 can be an opening, and the shape of the opening is designed according to the shape of a portion of the second lock 203 which is desired to be positioned. In one example, the second positioning portion 116 is a rectangular opening, and an escutcheon of the second lock 203 can be engaged in the second positioning portion 116, such that the second lock 203 can be positioned and supported on the plate portion 110. According to the aforementioned description, a portion of the plate portion 110 where the first positioning portion 115 and the second positioning portion 116 are not disposed can be defined as a "non-positioning portion". When the first lock 201 is positioned under the second surface 112 by the first positioning portion 115, and the second lock 203 is positioned on the first surface 111 by the second positioning portion 116, the non-positioning portion is capable of covering a handle of the first lock 201 and supporting a handle of the second lock 203.

Referring to FIG. 1 to FIG. 3, in one embodiment, a length L1 of the first side plate 120 relative to the second surface 112 is greater than a length L2 of the second side plate 130 relative to the second surface 112. Therefore, when the package holder 100 is put on a plane, the plate portion 110 is inclined relative to the plane. In addition, because the first positioning portion 115 and the second positioning portion 116 are respectively disposed adjacent to the opposite first side edge 113 and the second side edge 114, when the first lock 201 is positioned in the accommodating space 100*a* (i.e. under the second surface 112) by the first positioning portion 115, and the second lock 203 is positioned on the first surface 111 by the second positioning portion 116, the first lock 201 and the second lock 203 are separated alternately without contacting with each other. Therefore, the package holder 100 of the present invention can prevent the first lock 201 and the second lock 203 from being damaged due to colliding or rubbing against with each other.

Referring to FIG. 1 to FIG. 3 again, in one embodiment, the plate portion 110 further includes a first partition 117 and a second partition 118. The first partition 117 and the second partition 118 are disposed on the first surface 111 and face the same direction. The first partition 117 is disposed adjacent to the first positioning portion 115. As shown in FIG. 3, when the first lock 201 is positioned in the first positioning portion 115, a portion of the escutcheon of the first lock 201 is exposed. Therefore, the first partition 117 can cover a portion of the first positioning portion 115 and the exposed portion of the escutcheon, so as to prevent the first lock 201 from colliding with other objects. In some embodiments, each of the first partition 117 and the second partition 118 is a bending portion or an arc portion. In one example, the first partition 117 and the second partition 118 can be designed according to shapes of the escutcheons of the first lock 201 and the second lock 203. For example, when the escutcheon of the first lock 201 is circular, the first partition 117 is an arc portion, such that the first partition 117 can be fit on the exposed portion of the escutcheon of the first lock 201. When the escutcheon of the first lock 201 is rectangular, the first partition 117 is a bending portion, such that the first partition 117 can be fit on the exposed portion of the escutcheon of the first lock 201.

As shown in FIG. 1 to FIG. 3, the second partition 118 is disposed adjacent to the second position portion 116 and the second side edge 114. When the second lock 203 is positioned on the second positioning portion 116, the second partition 118 can abut against a portion of the second lock 203, and the second partition 118 can act as a cushion between the second lock 203 and an inner wall of an outer box 301. In other embodiments, when plural package holders 100 are alternately stacked, the second partition 118 of one package holder 100 can abut against the first side plate 120 of another package holder 100, so as to position the another package holder 100.

In some embodiments, each of a width of the first side plate 120 and a width of the second side plate 130 is tapered. In other words, a width of one side of the first side plate 120 connected to the first side edge 113 is greater than a width of the other side of the first side plate 120 away from the first side edge 113, and a width of one side of the second side plate 130 connected to the second side edge 114 is greater than a width of the other side of the second side plate 130 away from the second side edge 114. Therefore, when plural package holders 100 are alternately stacked, the first side plate 120 and the second side plate 130 of different package holders 100 will not interfere with each other.

Referring to FIG. 1 to FIG. 3 again, a procedure of using the package holder 100 to position the first lock 201 and the second lock 203 is described below. Firstly, the first lock 201 is disposed in the outer box 301. Before the first lock 201 is disposed in the outer box 301, a bottom box 302 accommodating plural installing components of the first lock 201 and the second lock 203 can be optionally disposed in the outer box 301. In one example, the bottom box 302 has plural through holes 302*a* on a top surface. The through holes 302*a* enable the users to know whether the installing components are in the bottom box 302. After the first lock 201 is disposed in the outer box 301, the package holder 100 is then disposed on the first lock 201 in the outer box 301, in which the first positioning portion 115 of the package holder 100 is engaged with the first lock 201, and the first partition 117 covers a portion of the first lock 201. Meanwhile, the first side plate 120 and the second side plate 130 of the package holder 100 and the second partition 118 of the plate portion 110 can abut against the inner wall of the outer box 301.

Thereafter, the second lock 203 is disposed on the package holder 100 in the outer box 301, and the second positioning portion 116 of the package, holder 100 is used to position the second lock 203, so as to fix the second lock 203 on the first surface 111 of the package holder 100, and simultaneously fix the first lock 201 in the accommodating space 100*a*. Because one side of the package holder 100 is higher than the other side, when the second lock 203 and the first lock 201 are alternately stacked via the package holder 100, the overall volume of the lock package 300 can be reduced.

Figure 4:
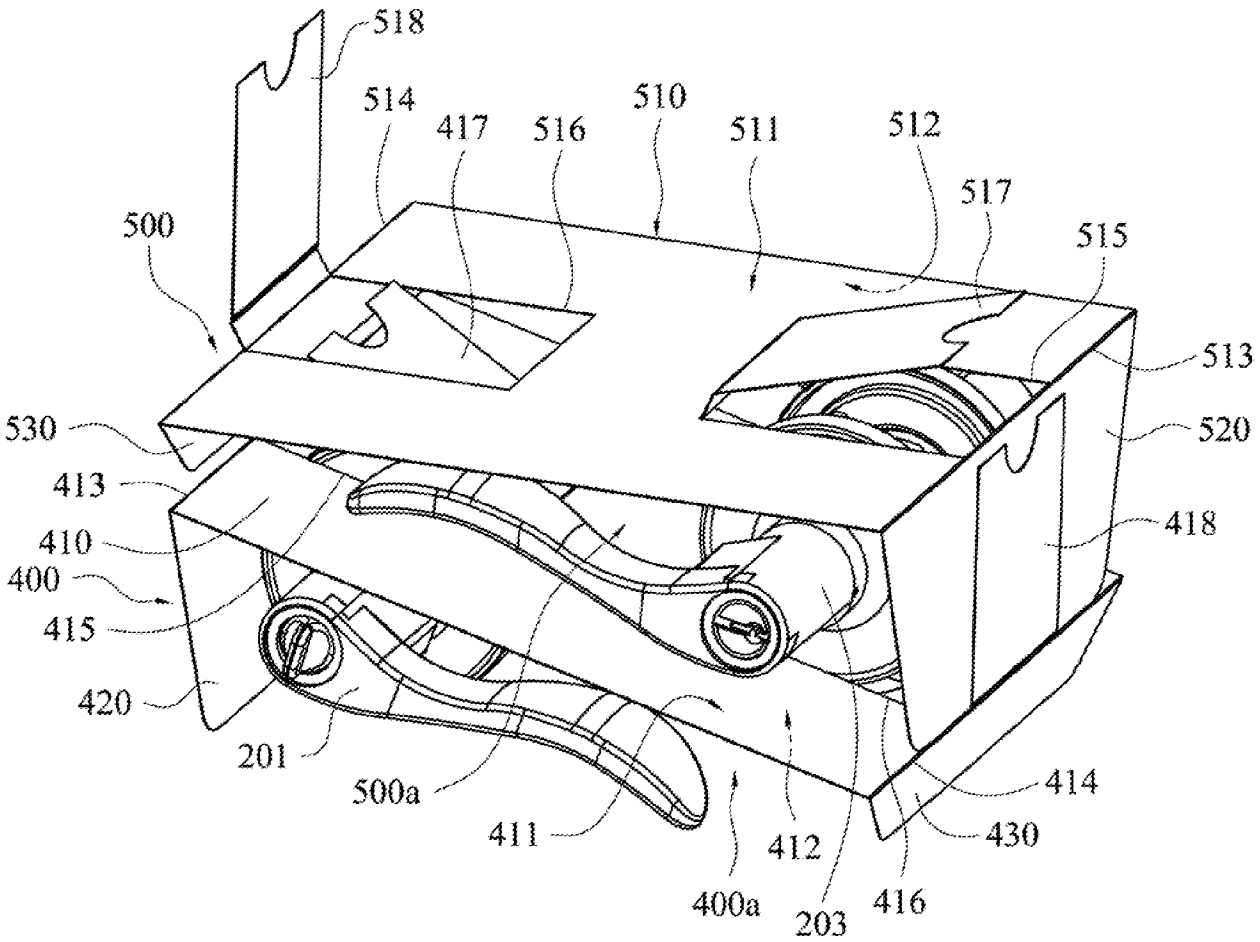
FIG. 4 is a schematic diagram showing two package holders in operation in accordance with an embodiment of the present invention.
Figure 5:
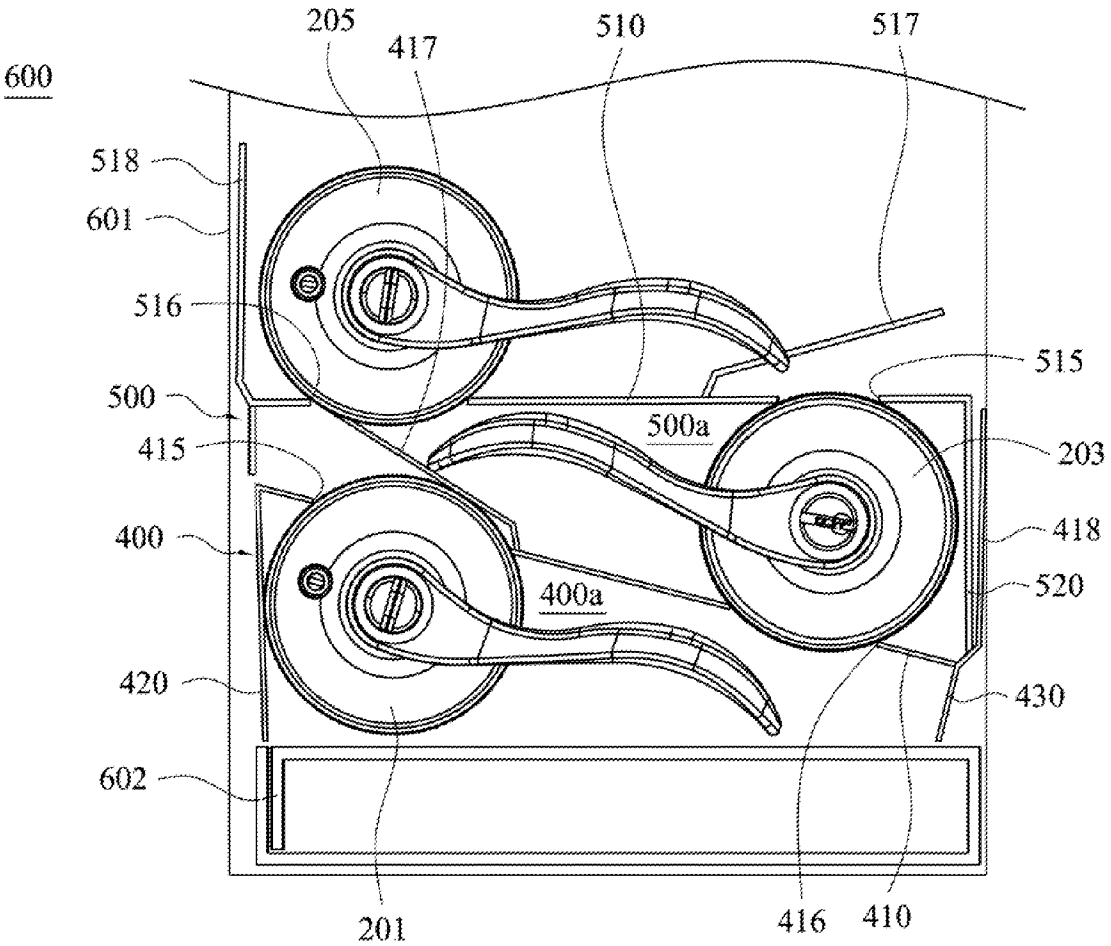
FIG. 5 is a schematic side view showing another lock package in accordance with an embodiment of the present invention.

It is noted that, the embodiment as shown in FIG. 3 uses one package holder collocated with two locks as an example for explanation, the numbers of the package holder and the locks of the present invention are not limited thereto. In other embodiments, more than two package holders can be used to simultaneously position more than three locks. Referring to FIG. 4 and FIG. 5, FIG. 4 is a schematic diagram showing two package holders in operation in accordance with an embodiment of the present invention, and FIG. 5 is a schematic side view showing another lock package 600 in accordance with an embodiment of the present invention.

A procedure of using two package holders to simultaneously position three locks is shown in FIG. 4 and FIG. 5. It is noted that, for clearly describing the relationship between two substantially the same package holders, terms of a "first package holder 400" and a "second package holder 500" are used to distinguish two substantially the same package holders. It is noted that, structures of the first package holder 400 and the second package holder 500 as shown in FIG. 4 and FIG. 5 and a structure of the package holder 100 as shown in FIG. 1 are substantially the same.

In other words, the first package holder 400 has an accommodating space 400*a* and includes a first plate portion 410, a first side plate 420 and a second side plate 430. The first plate portion 410 has a first surface 411, a second surface 412, a first side edge 413, a second side edge 414, a first positioning portion 415, a second positioning portion 416, a first partition 417 and a second partition 418. In the present embodiment, structures and an arrangement relationship of the first plate portion 410, the first side plate 420, the second side plate 430, and the first surface 411, the second surface 412, the first side edge 413, the second side edge 414, the first positioning portion 415, the second positioning portion 416, the first partition 417 and the second partition 418 of the first plate portion 410 are substantially the sane as those of the plate portion 110, the first side plate 120, the second side plate 130, and the first surface 111, the second surface 112, the first side edge 113, the second side edge 114 the first positioning portion 115, the second positioning portion 116, the first partition 117 and the second partition 118 of the plate portion 110, and will not be described again herein.

Similarly, the second package holder 500 has an accommodating space 500*a* and includes a second plate portion 510, a third side plate 520 and a fourth side plate 530. The second plate portion 510 has a third surface 511, a fourth surface 512, a third side edge 513, a fourth side edge 514, a third positioning portion 515, a fourth positioning portion 516, a third partition 517 and a fourth partition 518. In the present embodiment, structures and an arrangement relationship of the second plate portion 510, the third side plate 520, the fourth side plate 530, and the third surface 511, the fourth surface 512, the third side edge 513, the fourth side edge 514, the third positioning portion 515, the fourth positioning portion 516, the third partition 517 and the fourth partition 518 of the second plate portion 510 are substantially the same as those of the plate portion 110, the first side plate 120, the second side plate 130, and the first surface 111 the second surface 112, the first side edge 113, the second side edge 114, the first positioning portion 115, the second positioning portion 116, the first partition 117 and the second partition 118 of the plate portion 110, and will not be described again herein.

Referring to FIG. 4 and FIG. 5 again, a procedure of using the first package holder 400 and the second package holder 500 to position the first lock 201 the second lock 203 and a third lock 205 in an outer box 601 is described below. Firstly, the first lock 201 is disposed in the outer box 601. Before the first lock 201 is disposed in the outer box 601, a bottom box 602 accommodating plural installing components of the first lock 201, the second lock 203 and the third lock 205 can be optionally disposed in the outer box 601. After the first lock 201 is disposed in the outer box 601, the first package holder 400 is then disposed in the outer box 601 on the first lock 201, such that the first lock 201 is accommodated in the accommodating space 400*a* of the first package holder 400, and the first positioning portion 415 of the first package holder 400 is engaged with the first lock 201, and the first partition 417 covers a portion of the first lock 201. Meanwhile, the first side plate 420 and the second side plate 430 of the first package holder 400 and the second partition 418 can abut against the inner wall of the outer box 601.

Thereafter, the second lock 203 is disposed on the first package holder 400 in the outer box 601 and the second positioning portion 416 of the first package holder 400 is used to support the second lock 203, so as to fix the second lock 203 on the first package holder 400. Then, the second package holder 500 is disposed on the second lock 203 in the outer box 601, such that the second lock 203 is accommodated in the accommodating space 500*a* of the second package holder 500, in which the third positioning portion 515 of the second package holder 500 is engaged with the second lock 203, and the third partition 517 covers a portion of the second lock 203. Meanwhile, the third side plate 520 of the second package holder 500 can abut against an inner side of the second partition 418 of the first package holder 400, and the fourth partition 530 is located above the first side edge 413 and abuts against the inner wall of the outer box 601, so as to fix the second package holder 500 on the first package holder 400.

Thereafter, the third lock 205 is disposed on the second package holder 500 in the outer box 601, and the fourth positioning portion 516 of the second package holder 500 is used to support the third lock 205. When the third lock 205 is disposed on the second package holder 500, in addition to be supported by the fourth positioning portion 516, the third lock 205 can be separated from the first lock 201 by the first partition 417 which covers the first lock 201, so as to prevent the third lock 205 from being directly contacted with the first lock 201.

Because one side of each of the first plate portion 410 and the second plate portion 510 is higher than the other side, when the first package holder 400 and the second package holder 500 are alternately stacked and simultaneously position the first lock 201, the second lock 203 and the third lock 205, the overall volume of the lock package 600 can be reduced. According to the aforementioned description, if more numbers of locks are required, a third package holder can be disposed on the second package holder, a fourth package holder can be disposed on the third package holder, and so on.

It is noted that, the terms "first", "second", "third" and "fourth" recited in the specification are merely used to name the elements and should not be regarded as the order or the number of the elements.

It can be known from the aforementioned embodiments of the present invention that, one package holder can use its the first side plate, a second side plate, the first partition and the second partition package holder to be stacked with another package holder. Meanwhile, the package holder can prevent the locks from colliding with each other. In addition, the first positioning portion and the second positioning portion of the package holder can position and fix the locks. Therefore, by alternately arranging the package holders and the locks, the overall volume of the lock package thereof can be reduced. Moreover, the package holders can be stacked stably with each other by using the weight of locks, so as to increase stability of the overall lock package.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lock package, comprising:

a first lock;

a second lock; and a first package holder, comprising:

a first plate portion, having a first surface, a second surface opposite to the first surface, a first side edge and a second side edge opposite to the first side edge, wherein the first lock and the second lock are respectively disposed adjacent to the second surface and the first surface, and the first plate portion further comprises:

a first positioning portion, penetrating the first surface and the second surface, wherein the first positioning portion is disposed adjacent to the first side edge, and the first positioning portion is configured to position the first lock; and a second positioning portion, penetrating the first surface and the second surface, wherein the second positioning portion is disposed adjacent to the second side edge, and the second positioning portion is configured to position the second lock;

a first side plate, connected to the first side edge; and a second side plate, connected to the second side edge, wherein a first accommodating space is formed between the first side plate, the second side plate and the second surface, and the first accommodating space is configured to accommodate the first lock;

a second package holder, disposed above the first package holder, wherein the second package holder comprises:

a second plate portion, having a third surface, a fourth surface opposite to the third surface, a third side edge and a fourth side edge opposite to the third side edge, wherein the third surface faces the second lock, and the second plate portion further comprises:

a third positioning portion, penetrating the third surface and the fourth surface, wherein the third positioning portion is disposed adjacent to the third side edge, and the third positioning portion is configured to position the second lock; and a fourth positioning portion, penetrating the third surface and the fourth surface, wherein the fourth positioning portion is disposed adjacent to the fourth side edge, and the fourth positioning portion is configured to position a third lock;

a third side plate, connected to the third side edge; and a fourth side plate, connected to the fourth side edge, wherein a second accommodating space is formed between the third side plate, the fourth side plate and the fourth surface, and the second accommodating space is configured to accommodate the second lock.

2. The lock package of claim 1, wherein the first plate portion further comprises:

a first partition, disposed on the first surface adjacent to the first positioning portion; and a second partition, disposed on the first surface adjacent to the second positioning portion and the second side edge.

3. The lock package of claim 1, wherein a length of the first side plate relative to the second surface is greater than a length of the second side plate relative to the second surface.

4. The lock package of claim 1, wherein a width of one side of the first side plate connected to the first side edge is greater than a width of the other side of the first side plate away from the first side edge.

5. The lock package of claim 1, wherein a width of one side of the second side plate connected to the second side edge is greater than a width of the other side of the second side plate away from the second side edge.

6. The lock package of claim 1, wherein each of the first partition and the second partition is a bending portion or an arc portion.

7. The lock package of claim 1, further comprising an outer box, wherein the first lock, the second lock and the first package holder are disposed in the outer box.

8. The lock package of claim 1, wherein the first plate portion further comprises:

a first partition, disposed on the first surface adjacent to the first positioning portion; and a second partition, disposed on the first surface adjacent to the second positioning portion and the second side edge, wherein the second partition is configured to abut against the third side plate of the second package holder; and the second plate portion further comprises:

a third partition, disposed on the third surface adjacent to the third positioning portion; and a fourth partition, disposed on the third surface adjacent to the fourth positioning portion and the fourth side edge.

9. The lock package of claim 1, further comprising an outer box, wherein the first lock, the second lock, the third lock, the first package holder and the second package holder are disposed in the outer box.

* * * * *